US009403204B2

(12) United States Patent
Casterton et al.

(10) Patent No.: US 9,403,204 B2
(45) Date of Patent: Aug. 2, 2016

(54) HEAT EXCHANGER ASSEMBLY AND METHOD

(75) Inventors: Joel T. Casterton, Franksville, WI (US); Kevin G. Clabots, Muskego, WI (US); Kevin M. Eppers, South Milwaukee, WI (US)

(73) Assignee: Modine Manufacturing Company, Racine, WI (US)

( * ) Notice: Subject to any disclaimer, the term of this patent is extended or adjusted under 35 U.S.C. 154(b) by 1733 days.

(21) Appl. No.: 12/696,986

(22) Filed: Jan. 29, 2010

(65) Prior Publication Data

US 2011/0186276 A1 Aug. 4, 2011

(51) Int. Cl.

| | |
|---|---|
| ***F28F 7/00*** | (2006.01) |
| ***F28F 9/26*** | (2006.01) |
| ***F28F 9/22*** | (2006.01) |
| ***F28D 7/10*** | (2006.01) |
| ***B21D 53/02*** | (2006.01) |
| ***F28F 9/02*** | (2006.01) |

(52) U.S. Cl.
CPC . *B21D 53/02* (2013.01); *F28F 9/02* (2013.01); *Y10T 29/4935* (2015.01)

(58) Field of Classification Search
CPC ..... F28D 7/16; F28D 7/163; F28F 2265/26; F28F 2265/30; F28F 9/013; F28F 9/0219; F28F 9/26
USPC ..... 165/140, 81, 82, 143, 144, 145, 52
See application file for complete search history.

(56) References Cited

U.S. PATENT DOCUMENTS

| | | | |
|---|---|---|---|
| 1,304,496 | A | 5/1919 | MacLachlan |
| 1,541,519 | A | 6/1925 | McKee |
| 1,600,013 | A | 9/1926 | Price |
| 1,655,086 | A | 1/1928 | Blanding |
| 1,803,035 | A | 4/1931 | Potter |
| 1,845,005 | A | 2/1932 | Schellens |
| 1,918,601 | A | 7/1933 | Jacocks et al. |

(Continued)

FOREIGN PATENT DOCUMENTS

| | | |
|---|---|---|
| CN | 1685192 | 10/2005 |
| CN | 1761809 | 4/2006 |

(Continued)

OTHER PUBLICATIONS

Office Action from the United States Patent Office for U.S. Appl. No. 11/764,491 dated Aug. 2, 2010 (5 pages).

(Continued)

*Primary Examiner* — Judy Swann
*Assistant Examiner* — Jason Thompson
(74) *Attorney, Agent, or Firm* — Michael Best & Friedrich LLP

(57) ABSTRACT

A heat exchanger includes a casing, a fluid flow path extending between first and second ends of the casing; first and second bundles of heat exchanger tubes in first and second portions of a fluid flow path extending through the casing, and a third section of the fluid flow path connecting the first and second sections and having a sealing plate with one or more apertures for the fluid flow path to pass therethrough. By virtue of the sealing plate and its relationship with the adjacent structure of the heat exchanger, adjacent ends of the two bundles of tubes are each movable in at least one direction with respect to the casing and the other bundle of tubes.

14 Claims, 9 Drawing Sheets

(56) References Cited

U.S. PATENT DOCUMENTS

| | | | | |
|---|---|---|---|---|
| 2,070,427 | A | 2/1937 | Faunce | |
| 2,297,165 | A | 9/1942 | Ringel | |
| 2,595,822 | A | 5/1952 | Uggerby | |
| 2,873,098 | A | 2/1959 | Morgan | |
| 2,969,956 | A * | 1/1961 | Forgo | 165/175 |
| 3,012,761 | A | 12/1961 | Gardner et al. | |
| 3,318,375 | A * | 5/1967 | Linder et al. | 165/164 |
| 3,804,161 | A | 4/1974 | Nowak | |
| 4,208,529 | A * | 6/1980 | Murray | 528/501 |
| 4,215,745 | A | 8/1980 | Tuckmantel | |
| 4,254,826 | A * | 3/1981 | Adams | 165/143 |
| 4,426,965 | A | 1/1984 | Patel | |
| 4,733,722 | A | 3/1988 | Forbes et al. | |
| 4,768,585 | A | 9/1988 | Hayes et al. | |
| 4,770,234 | A | 9/1988 | Hiraoka et al. | |
| 4,834,173 | A | 5/1989 | Weiss et al. | |
| 5,388,638 | A | 2/1995 | Gentry | |
| 5,644,842 | A | 7/1997 | Coleman | |
| 5,915,472 | A | 6/1999 | Takikawa et al. | |
| 6,016,865 | A | 1/2000 | Blomgren | |
| 6,089,313 | A * | 7/2000 | Levy et al. | 165/140 |
| 6,244,256 | B1 | 6/2001 | Wall et al. | |
| 6,260,609 | B1 | 7/2001 | Takahashi | |
| 6,340,051 | B1 | 1/2002 | Bloksma | |
| 6,612,293 | B2 | 9/2003 | Schweinzer et al. | |
| 6,718,956 | B2 | 4/2004 | Klipfel et al. | |
| 6,874,572 | B2 | 4/2005 | Wanni et al. | |
| 6,920,918 | B2 | 7/2005 | Knecht et al. | |
| 7,077,114 | B2 | 7/2006 | Husges | |
| 7,080,634 | B2 | 7/2006 | Yamashita | |
| 7,171,956 | B2 | 2/2007 | Igami et al. | |
| 7,182,074 | B1 | 2/2007 | Redon et al. | |
| 7,185,642 | B1 | 3/2007 | Redon et al. | |
| 7,213,639 | B2 | 5/2007 | Danielsson et al. | |
| 7,380,544 | B2 | 6/2008 | Raduenz et al. | |
| 7,527,088 | B2 | 5/2009 | Hayashi et al. | |
| 8,002,022 | B2 | 8/2011 | Geskes | |
| 8,011,422 | B2 | 9/2011 | Yamazaki et al. | |
| 8,033,323 | B2 | 10/2011 | Schatz et al. | |
| 2006/0090880 | A1 | 5/2006 | Sugihara et al. | |
| 2006/0102321 | A1 * | 5/2006 | Shincho et al. | 165/81 |
| 2006/0196052 | A1 * | 9/2006 | Lesage | 29/890.043 |
| 2006/0201661 | A1 | 9/2006 | Sugihara et al. | |
| 2006/0201663 | A1 | 9/2006 | Strahle et al. | |
| 2006/0231243 | A1 | 10/2006 | Sugihara et al. | |
| 2007/0017661 | A1 | 1/2007 | Geskes et al. | |
| 2007/0131400 | A1 | 6/2007 | Gracia et al. | |
| 2007/0267000 | A1 * | 11/2007 | Raduenz et al. | 123/568.12 |
| 2008/0006398 | A1 * | 1/2008 | Schatz et al. | 165/177 |
| 2008/0202724 | A1 | 8/2008 | Lorenz et al. | |
| 2008/0202739 | A1 | 8/2008 | Barfknecht et al. | |
| 2008/0289804 | A1 | 11/2008 | Baumann et al. | |
| 2008/0302094 | A1 * | 12/2008 | Yoon | 60/320 |
| 2009/0113909 | A1 * | 5/2009 | Liu et al. | 62/235.1 |
| 2009/0194266 | A1 * | 8/2009 | Conrad et al. | 165/165 |
| 2011/0056652 | A1 | 3/2011 | Neher et al. | |

FOREIGN PATENT DOCUMENTS

| | | |
|---|---|---|
| DE | 2339364 | 2/1975 |
| DE | 3242619 | 6/1983 |
| DE | 3811961 | 6/1989 |
| DE | 19721132 | 11/1997 |
| DE | 10157285 | 6/2003 |
| DE | 10312788 | 9/2004 |
| DE | 102005054731 | 5/2007 |
| EP | 1348924 | 10/2003 |
| EP | 1544564 | 6/2005 |
| EP | 1548386 | 6/2005 |
| EP | 2017455 | 1/2009 |
| JP | 7305987 | 11/1995 |
| JP | 11013555 | 1/1999 |
| JP | 11023182 | 1/1999 |
| WO | 03/001650 | 1/2003 |
| WO | 03/036214 | 5/2003 |
| WO | 03/064953 | 8/2003 |

OTHER PUBLICATIONS

Office Action from SIPO for Chinese Application 200710106787.X dated Mar. 11, 2010 (7 pages—English Translation).

Office Action from the Patent Office of the People's Republic of China for Application No. 200910135291.4 dated Mar. 1, 2012 (English Translation and Original, 19 pages).

Office Action from the United States Patent and Trademark Office for U.S. Appl. No. 12/464,200 dated Jun. 1, 2012 (9 pages).

Jinyuan et al., "Tube Vibration Reliability Design of Tubular Heat Exchangers for Thermal Systems of Steam Turbines," Proceedings of the Chinese Society for Electrical Engineering, Shanghai Power Equipment Research Institute, vol. 18, Apr. 1998, pp. 292-294.

Au-Yang, "The Crossing Frequency as a Measure of Heat Exchanger Suppoer-Plate Effectiveness," Journal of Fluids and Structures, Jan. 2002, vol. 16, Iss. 1, pp. 83-92.

Office Action from the United States Patent and Trademark Office for U.S. Appl. No. 11/764,491 dated Jan. 5, 2011 (13 pages).

Office Action from the United States Patent and Trademark Office for U.S. Appl. No. 12/896,651 dated Feb. 5, 2014 (12 pages).

* cited by examiner

HEAT EXCHANGER ASSEMBLY AND METHOD

BACKGROUND OF THE INVENTION

Emission concerns associated with the operation of internal combustion engines (e.g., diesel and other types of engines) have resulted in an increased emphasis on the use of exhaust gas heat exchange systems with such engines in vehicular and non-vehicular applications. These systems are often employed as part of an exhaust gas recirculation (EGR) system in which a portion of an engine's exhaust is returned to combustion chambers via an intake system. The result is that some of the oxygen that would ordinarily be inducted into the engine as part of its fresh combustion air charge is displaced with inert gases. The presence of the inert exhaust gas typically serves to lower the combustion temperature, thereby reducing the rate of $NO_x$ formation.

In order to achieve the foregoing, it is desirable for the temperature of the recirculated exhaust to be lowered prior to the exhaust being delivered into the intake manifold of the engine. In many applications employing EGR systems, exhaust gas recirculation coolers (EGR coolers) are employed to reduce the temperature of the recirculated exhaust. In the usual case, engine coolant is brought into heat exchange relation with the exhaust gas within the EGR cooler in order to achieve the desired reduction in temperature. The use of engine coolant provides certain advantages in that appropriate structure for subsequently rejecting heat from the engine coolant to the ambient air is already available for use in applications requiring an EGR system.

In some applications, however, the temperature to which recirculated exhaust must be lowered in order to achieve the desired reduction in the rate of $NO_x$ formation is lower than, or appreciably close to, the temperature at which the engine coolant is regulated by the engine's thermal management system. In such cases, a second EGR cooler may be employed to extract from the recirculated exhaust that portion of the desired heat load which cannot be readily transferred to the engine coolant at its regulated temperature. This second EGR cooler (frequently referred to as a "low temperature EGR cooler" or "LT EGR cooler") commonly receives either a flow of coolant from a separately regulated coolant loop, or a portion of the regular engine coolant loop which has been cooled to a lower temperature.

Packaging the LT EGR cooler along with an EGR cooler (sometimes referred to as the "high temperature EGR cooler" or "HT EGR cooler") can be problematic due to space constraints. Placing both EGR coolers into a common casing can help to ease these packaging issues, but can make it more difficult to accommodate the differences in thermal expansion between the exhaust gas conveying tubes in the EGR coolers and the casing. Such thermal expansion differences have been known to lead to premature failure of the heat exchanger.

Although applications involving EGR cooler connections (to other EGR coolers and/or other structures) illustrate the design challenges described above, such challenges exist in other heat exchanger applications as well—some of which involve heat exchangers outside of exhaust gas recirculation technology. Based upon these and other limitations of conventional heat exchanger connection designs, improved heat exchanger connections and connection methods continue to be welcome in the art.

SUMMARY OF THE INVENTION

In accordance with some embodiments, of the present invention, a heat exchanger includes a casing having a proximal end and a distal end, with a fluid flow path extending from the proximal end to the distal end. The heat exchanger further includes a plurality of heat exchange tubes defining a first section of the fluid flow path extending from the proximal end, and another plurality of heat exchange tubes defining a second section of the fluid flow path extending to the distal end. A third section of the fluid flow path fluidly connects the first section to the second section, and includes at least one sealing plate. The heat exchange tubes defining the first section are rigidly attached to the casing at the proximal end, and are structurally decoupled from the casing at their opposite ends. The heat exchange tubes defining the second section are rigidly attached to the casing at the distal end, and are structurally decoupled from both the casing and the heat exchange tubes defining the first section at their opposite ends.

Another feature of the present invention includes a casing having a pocket containing at least a portion of the sealing plate. The pocket is defined by a planar wall that provides a sealing surface for a fluid-tight seal between the casing and the sealing plate, and by one or more peripheral walls that bound the outer periphery of the planar wall. The pocket may be further defined by another planar wall that is parallel to and spaced apart from the first planar wall. This second planar wall can provide a sealing surface for a fluid-tight seal between the casing and a second sealing plate.

In some embodiments, the third section of the fluid flow path includes a group of one or more cylindrical flow conduits rigidly attached to the heat exchange tubes defining the first section, and a group of one or more cylindrical flow conduits rigidly attached to the heat exchange tubes of defining the second section. At least one of the groups extends at least partially into the pocket in the casing. As one feature, fluid-tight seals extend around one or more of the cylindrical flow conduits and allow for movement in the axial direction relative to the casing. The first and second groups of cylindrical flow conduits may be separated from one another in order to accommodate thermal expansion differences between the heat exchange tubes and the casing.

In some embodiments of the present invention, the heat exchanger includes a second fluid flow path passing over the heat exchange tubes defining the first section, and a third fluid flow path passing over the heat exchange tubes defining the second section. The second and third fluid flow paths are sealed off from the first fluid flow path by at least some of the fluid-tight seals in the third section of the first fluid flow path. In some cases the second and third fluid flow paths are not in fluid communication with one another within the heat exchanger.

In some embodiments of the invention the heat exchanger may be used as an EGR cooler, with a recirculated exhaust gas flowing along the first flow path, a first flow of coolant flowing along the second flow path, and a second flow of coolant flowing along the third flow path. In some cases one of the flows of coolant may be at a lower temperature than the other flow of coolant.

In accordance with some embodiments of the present invention, a heat exchanger includes a casing having a proximal end and a distal end, with a fluid flow path extending from the proximal end to the distal end. The heat exchanger further includes a first plurality of heat exchange tubes defining a portion of the fluid flow path including the proximal end, and a second plurality of heat exchange tubes defining a portion of the fluid flow path including the distal end. A flow transitioning structure defines the fluid flow path between the distal end of the first plurality of heat exchange tubes and the proximal end of the second plurality of heat exchange tubes, and structurally decouples the distal end of the first plurality of heat exchange tubes from the proximal end of the second plurality of heat exchange tubes.

In some embodiments, the casing includes a pocket containing at least a portion of the flow transitioning structure. The pocket is defined by a planar wall that provides a sealing surface for a fluid-tight seal between the casing and the flow transitioning structure, and by one or more peripheral walls that bound the outer periphery of the planar wall. The pocket may be further defined by another planar wall that is parallel to and spaced apart from the first planar wall. This second planar wall can provide a another sealing surface for another fluid-tight seal between the casing and the flow transitioning structure.

Other objects, features, and advantages of the invention will become apparent from a review of the entire specification, including the appended claims and drawings.

DETAILED DESCRIPTION OF THE PREFERRED EMBODIMENT

Figure 1:
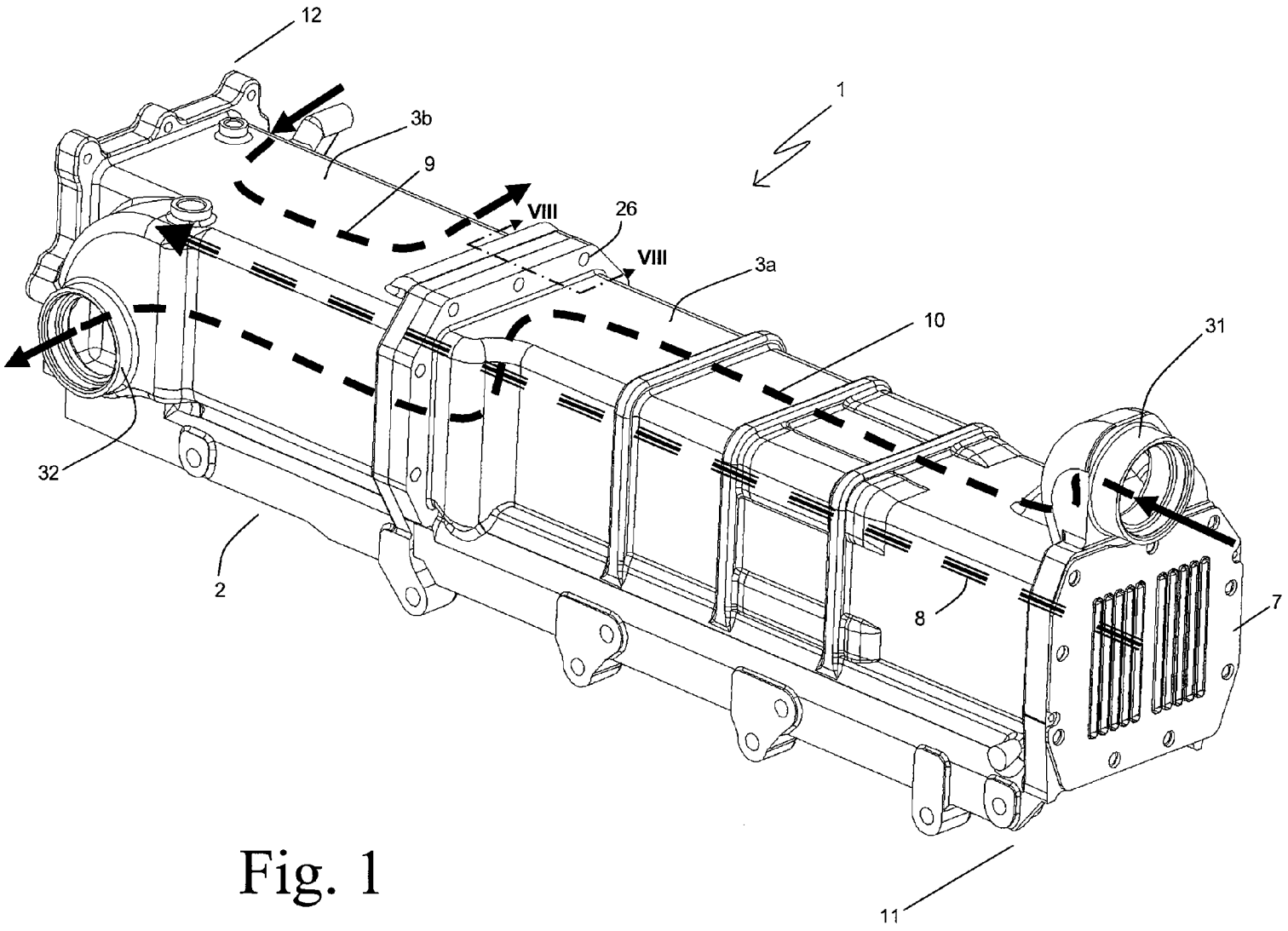
FIG. 1 is a perspective view of a heat exchanger according to an embodiment of the present invention.

Before any embodiments of the present invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

An embodiment of a heat exchanger 1 according to the present invention is shown in FIGS. 1-8*a*, and includes a heat exchanger 1 providing a flow path 8 for a fluid to pass through the heat exchanger 1, wherein the flow path 8 extends from a proximal end 11 of the heat exchanger 1 to a distal end 12 of the heat exchanger 1. The flow path 8 is enclosed within a casing 2, which can comprise multiple casing sections 3. As further shown in FIG. 1, the casing 2 of the illustrated embodiment additionally encloses flow paths 9 and 10, along which one or more fluids can be passed through the heat exchanger 1 so as to be placed in heat exchange relation with a fluid passing along the flow path 8.

Although FIG. 1 shows the flow paths 8 and 9 to be in counter-current flow orientation, it should be understood that in some applications, other flow orientations (such as, for example, concurrent flow), may be preferred or equally suitable. Similarly, although flow paths 8 and 10 are depicted as being in concurrent flow orientation, it should be understood that in some applications, other flow orientations, such as, for example, counter-current flow, may be preferred or equally suitable.

Figure 2:
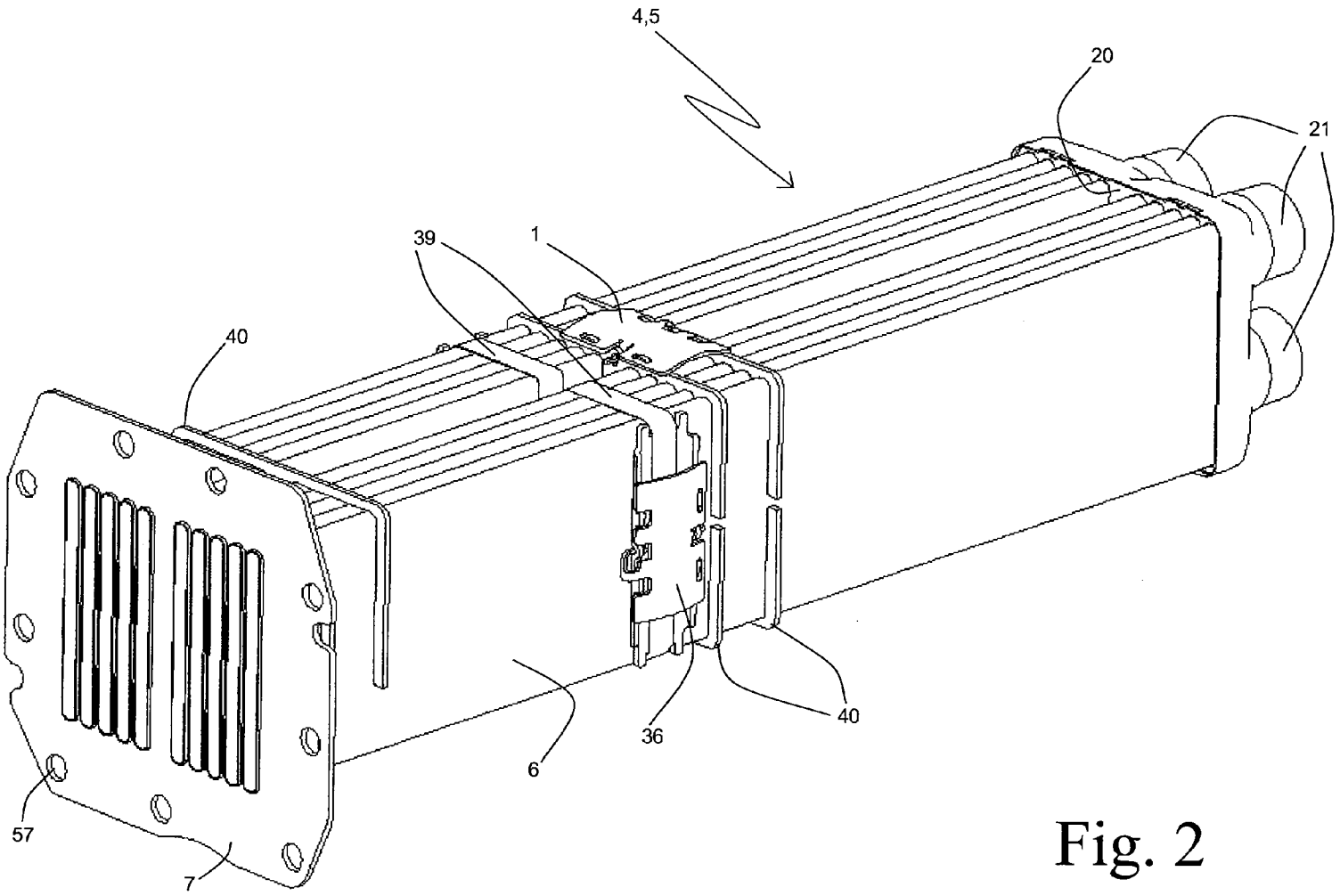
FIG. 2 is a perspective view of a heat exchanger core for use in the heat exchanger of FIG. 1.

The fluid flow paths 8, 9 and 10 of the illustrated embodiment are at least partially defined by first and second heat exchange cores 4 and 5, shown generically in FIG. 2. Each heat exchange core 4, 5 of the heat exchanger 1 shown in FIG. 1 has a construction as shown in FIG. 2 (although adapted in length as needed to match the casings 3*a*, 3*b* into which the cores 4, 5 are received, as necessary). Each of the cores 4, 5 include a bundle of parallel heat exchange tubes 6 extending between a first header 7 and a second header 20. Ends of the tubes 6 are sealingly attached to the headers 7, 20, such as by brazing, welding, or in any other suitable manner. Cylindrical flow conduits 21 are provided at that end of the core 5 where the tubes 6 are attached to the header 20, to at least partially define another portion of the fluid flow path 8 downstream or upstream of the portion defined by the heat exchange tubes 6. It should be understood that, although the exemplary embodiment depicts four of the cylindrical flow conduits 21, the number of flow conduits present in a given application may be less than or more than four, without limitation.

The heat exchange cores 4, 5 further may include one or more baffles 40 arranged along the length of either or both heat exchange cores 4, 5. Such baffles 40 can provide benefit during assembly of the heat exchange cores 4, 5 by maintaining desired spacing between the tubes 6. In some embodiments, the baffles 40 can define a tortuous portion of the flow path 9 or 10 over the outer surfaces of the heat exchange tubes 6 in order to increase the rate of heat transfer between fluids traveling over and through the tubes. Alternatively or in addition, fluid flow plates (not shown) can be included between adjacent heat exchange tubes 6 in order to direct a fluid flowing along the flow path 9 or 10.

In some embodiments, the heat exchange cores 4, 5 can include spring plates 36 around one or more of the outer surfaces of the bundles of tubes 6. The utility of these spring plates 36 will be discussed in detail below. In some cases, one or more of the spring plates 36 can be attached directly to one or more of the baffles 40. Alternatively or in addition, one or more of the spring plates 36 can be attached to straps 39 wrapped around one or more of the heat exchange tubes 6, and/or other structure located adjacent, between, or around the heat exchange tubes 6.

Figure 3:
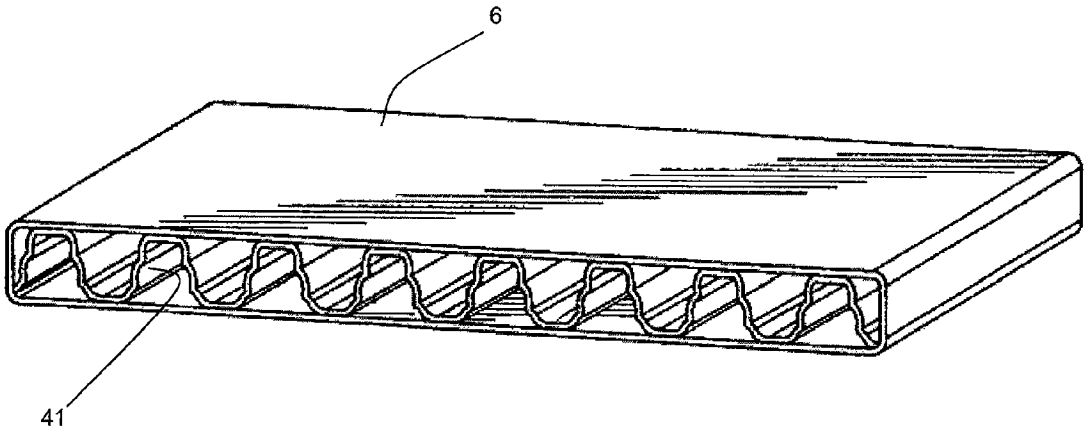
FIG. 3 is a perspective view of a tube and insert for use in the heat exchange core of FIG. 2.

It should be readily apparent to those having skill in the art that the heat exchange tubes 6 can take many different forms. In some embodiments, such as that shown in FIG. 2, the tubes 6 can be flat tubes having first and second opposing substantially flat and long walls connected with relatively short (and in some cases, arcuately shaped) walls. In other embodiments, the tubes 6 can have a more rectangular shape, as shown in FIG. 3. In still other embodiments, the tubes 6 can have a circular cross-sectional shape, or can be constructed from two or more stacked plates. Also, in some embodiments, one or more of the heat exchange tubes 6 include an insert 41 (shown in FIG. 3) floating within or bonded to the inner walls of the tubes 6 to improve the rate of heat transfer to or from fluid traveling through the tubes 6.

While the cores 4 and 5 for a given heat exchanger 1 may be identical to one another in some cases, it should be understood that there is no requirement for them to be identical. In some cases, the cores 4, 5 can differ in a variety of ways, including but not limited to tube length, tube size, number of tubes, arrangement of tubes 6, and the like.

Figure 4:
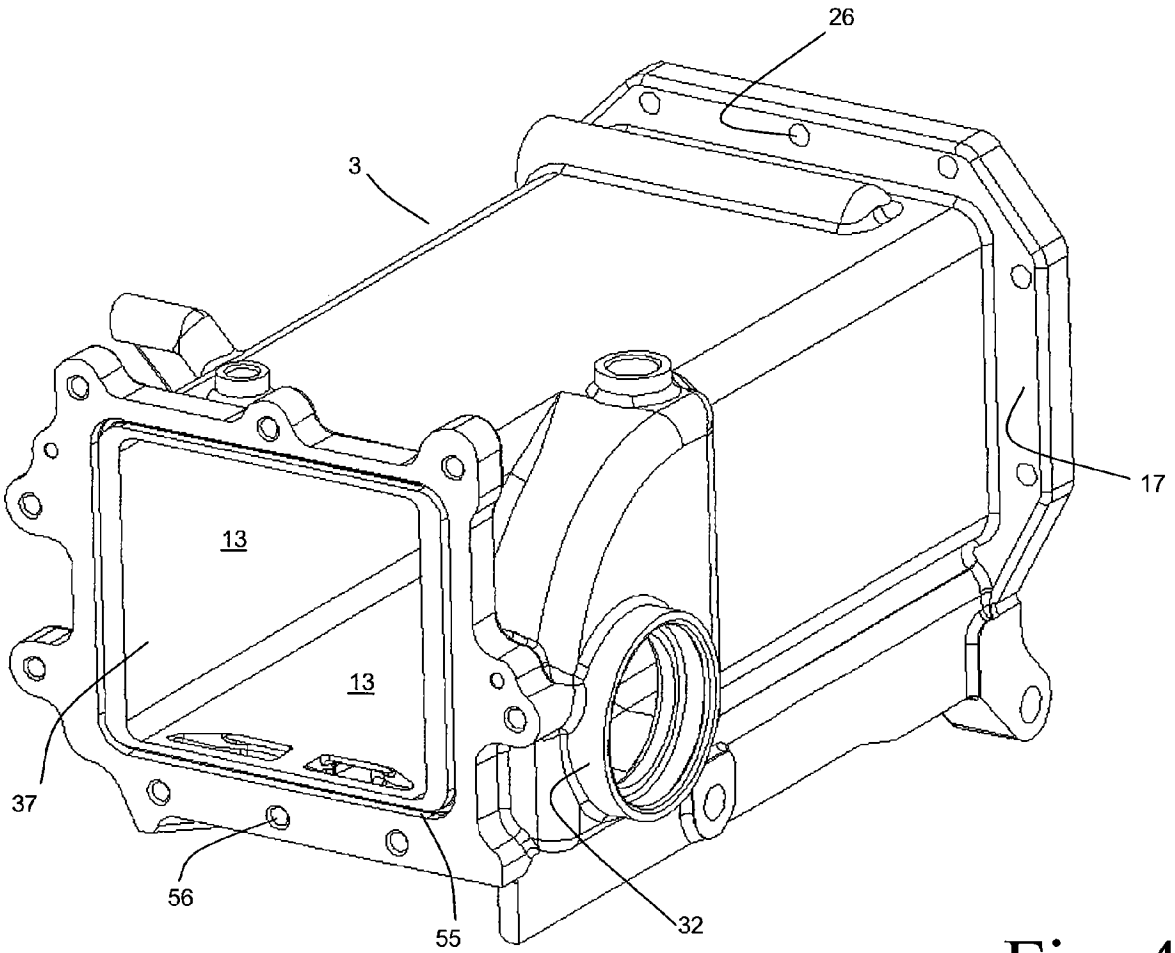
FIG. 4 is a perspective view of a casing section of the heat exchanger of FIG. 1.
Figure 5:
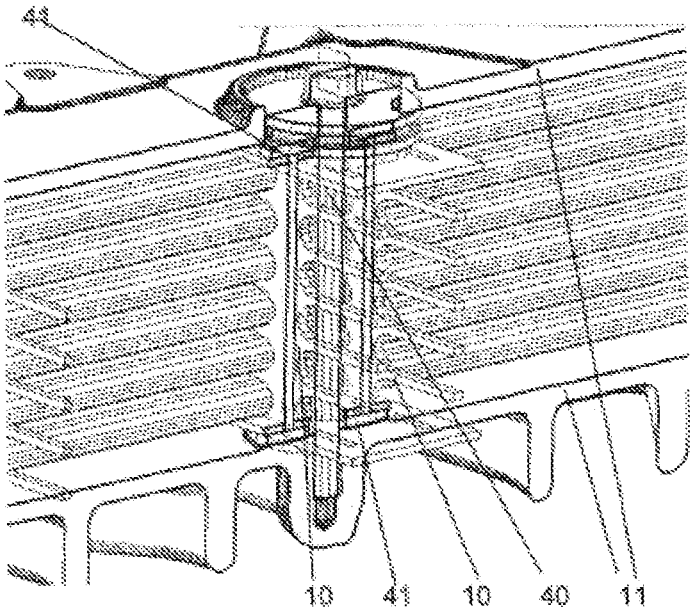
FIG. 5 is another perspective view of the casing section of FIG. 4.

Turning now to FIGS. 4 and 5, certain aspects of a casing section 3 will be discussed. Although the specific casing section 3 shown in FIGS. 4 and 5 corresponds to the casing section 3*b* in FIG. 1, it should be understood that certain features shown in FIGS. 4 and 5 can similarly be found in the casing section 3*a* of FIG. 1.

The casing section 3 of FIGS. 4 and 5 includes a first opening 37 at a first end of the casing section 3, and a second opening 38 at a second end opposite the first end. The opening 37 can be sized to accommodate the entirety of a core 4 or 5 (in some cases, without the header plate 7). The opening 38 can be smaller than the opening 37, and can be sized to at least accommodate the one or more cylindrical flow conduits 21 of a core 4 or 5.

The illustrated casing section 3 further includes a plurality of fastening locations 26 at the second end. These fastening locations 26 can be located in a flange 17 at the second end. While the specific fastening locations 26 shown in the accompanying figures are depicted as circular through-holes, it should be understood that any other assembly features suitable for assembling casing sections can be similarly substituted. For example, the fastening locations 26 can, in some cases, take the form of pins, V-band grooves, blind threaded holes, etc.

The casing section 3 can include a pocket 16 at the second end. In some embodiments, the pocket 16 is defined by a planar wall 14 in which the opening 38 is located, and by one or more walls 15 bounding the outer periphery of the planar wall 14. In other embodiments, the pocket 16 can be defined by other portions of the casing while still providing a recess open to and facing away from the rest of the casing section 3, and can be wider, thinner, deeper, or shallower as desired. Additionally, the casing section 3 may optionally include a groove 27 at the second end, with the opening 38 at least partially enclosed by the groove 27. In those embodiments in which both a pocket 16 and a groove 27 are present, the groove 27 can encircle the pocket 16, as shown in FIG. 5.

In some embodiments, the casing section 3 includes one or more of the following: an inlet 33 to receive a fluid traveling along the flow path 9 into the heat exchanger 1; an outlet 34 to remove a fluid traveling along the flow path 9 from the heat exchanger 1; an inlet 31 to receive a fluid traveling along the flow path 10 from the heat exchanger 1; and an outlet 32 to remove a fluid traveling along the flow path 10 from the heat exchanger 1. A casing section 3 can also include a flow conduit 54 to allow a fluid traveling along one of the flow paths 9, 10 to transfer from the casing section 3 to another casing section 3 without exiting the heat exchanger 1. Such a flow conduit 54 can, if present, be advantageously disposed within the boundaries of the groove 27, if present.

Figure 6:
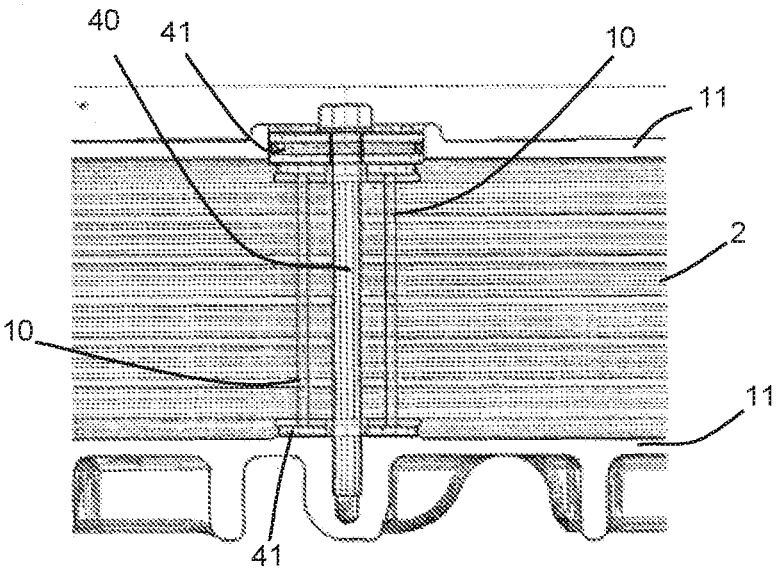
FIG. 6 is a partially exploded and partially cut-away perspective view of a portion of the heat exchanger of FIG. 1.
Figure 7:
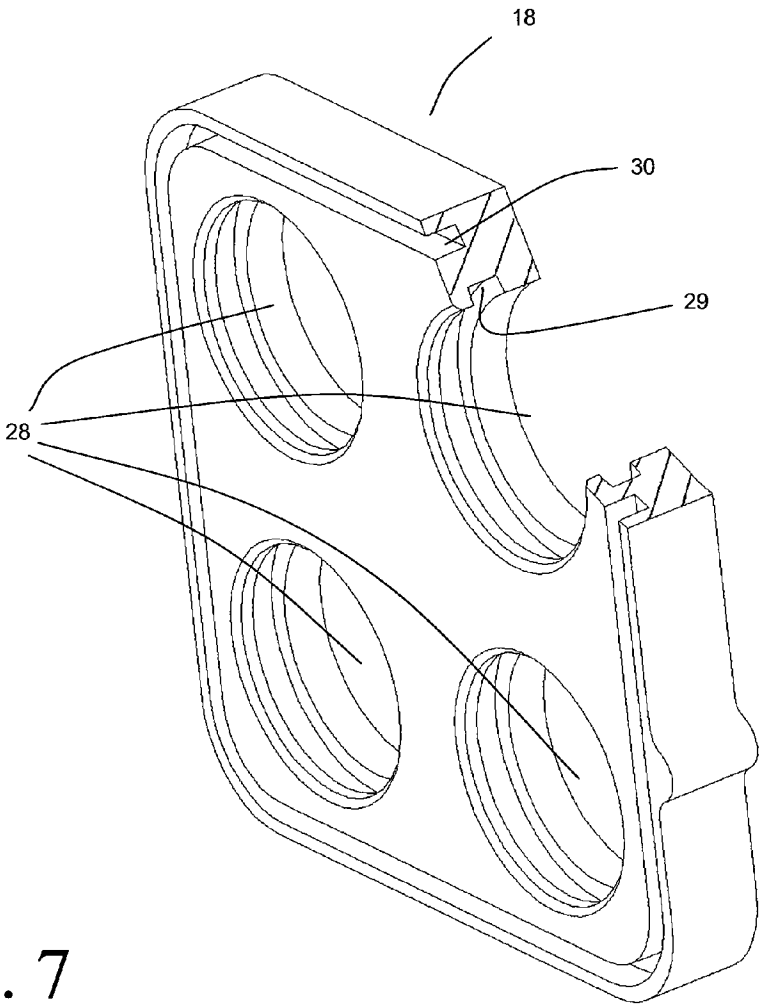
FIG. 7 is a cut-away perspective view of a sealing plate for use in the heat exchanger of FIG. 1.

Heat exchange cores 4 and 5 can each be assembled into respective ones of the casing sections 3*a* and 3*b*, as shown in FIG. 6. A core 4 or 5 can be inserted into a casing section 3 by passing the core 4, 5 through the opening 37 of the respective casing section 3*a*, 3*b*, starting with the cylindrical conduits 21, until the header 7 of the core 4, 5 reaches the casing section 3*a*, 3*b*, respectively. Spring plates 36 assembled to outer surfaces of the core 4, 5 can be used to locate the core 4, 5 within the casing section 3*a*, 3*b* by engaging with, and sliding along, one or more inner surfaces 13 of the casing section 3*a*, 3*b*. The spring plates 36 can have a suitable compliancy such that they can deform to allow for contact between all of the spring plates 36 and their corresponding adjacent walls 13. This allows the core 4, 5 to be firmly contained within the respective casing section 3*a*, 3*b* in order to withstand shock and/or vibration loadings that may be experienced during operation of the heat exchanger 1, even when the inner surfaces 13 of the casing sections 3*a*, 3*b* are uneven, and/or have varying surfaces resulting from production variations and manufacturing tolerances (e.g., in casting processes).

Once the heat exchange core 4, 5 is so assembled into the respective casing section 3*a*, 3*b*, the header 7 of the core 4, 5 can be fastened to the end of the casing 4, 5 in a leak-tight fashion. In some embodiments, this fastening is achieved through the use of mechanical fasteners, such as, for example, bolts that extend through holes 57 found in the header 7 and into corresponding threaded holes 56 in the end of the casing 3*a*, 3*b*. A gasket (not shown) can be placed into a groove 55 or can be otherwise installed at another suitable feature at the mating face of the casing 3*a*, 3*b* either during or prior to assembly in order to effect a leak-free joint between the header 7 and the casing 3*a*, 3*b*. In other cases, a leak-free joint can instead be achieved by welding the header 7 to the casing 3*a*, 3*b* along the entire periphery of these elements.

It should be appreciated that assembling the core 4, 5 into the casing section 3*a*, 3*b* as described allows for the location of cylindrical flow conduit(s) 21 of the core 4, 5 to vary within the casing section 3*a*, 3*b*, since that location will be dictated by the bearing of the spring plates 36 on the inner casing walls 13.

A sealing plate 18 (shown in greater detail in FIG. 7) is assembled onto the end of the heat exchange core 4, 5 by insertion of the cylindrical flow conduits 21 through corresponding apertures 28 in the sealing plate 18. A sealing gasket 22 (shown in FIGS. 8*a* and 8*b*), such as an O-ring, can be placed into a groove 29 located within each of the apertures 28 in order to achieve a fluid-tight seal between the cylindrical flow conduits 21 and the sealing plate 18. In embodiments in which a plurality of cylindrical flow conduits 21 are used, excellent registration between the sealing plate 18 and the cylindrical flow conduits 21 can be achieved, owing to the unitary construction of both the sealing plate 18 and the end portion of the core 4, 5 containing the cylindrical flow conduits 21, despite the variable location of the core 4, 5 within the casing 3*a*, 3*b*.

When the casing section 3*a*, 3*b* includes a pocket 16 as described above, the sealing plate 18 can advantageously be received into the pocket 16 such that assembly of the sealing plate 18 does not increase the overall length of the heat exchanger 1. The pocket 16 can be larger than the sealing plate 18 so that a sufficient clearance gap is provided between the peripheral walls 15 of the pocket and the sealing plate in order to allow for variability in the location of the cylindrical flow conduits 21 within the pocket 16.

Figure 8A:
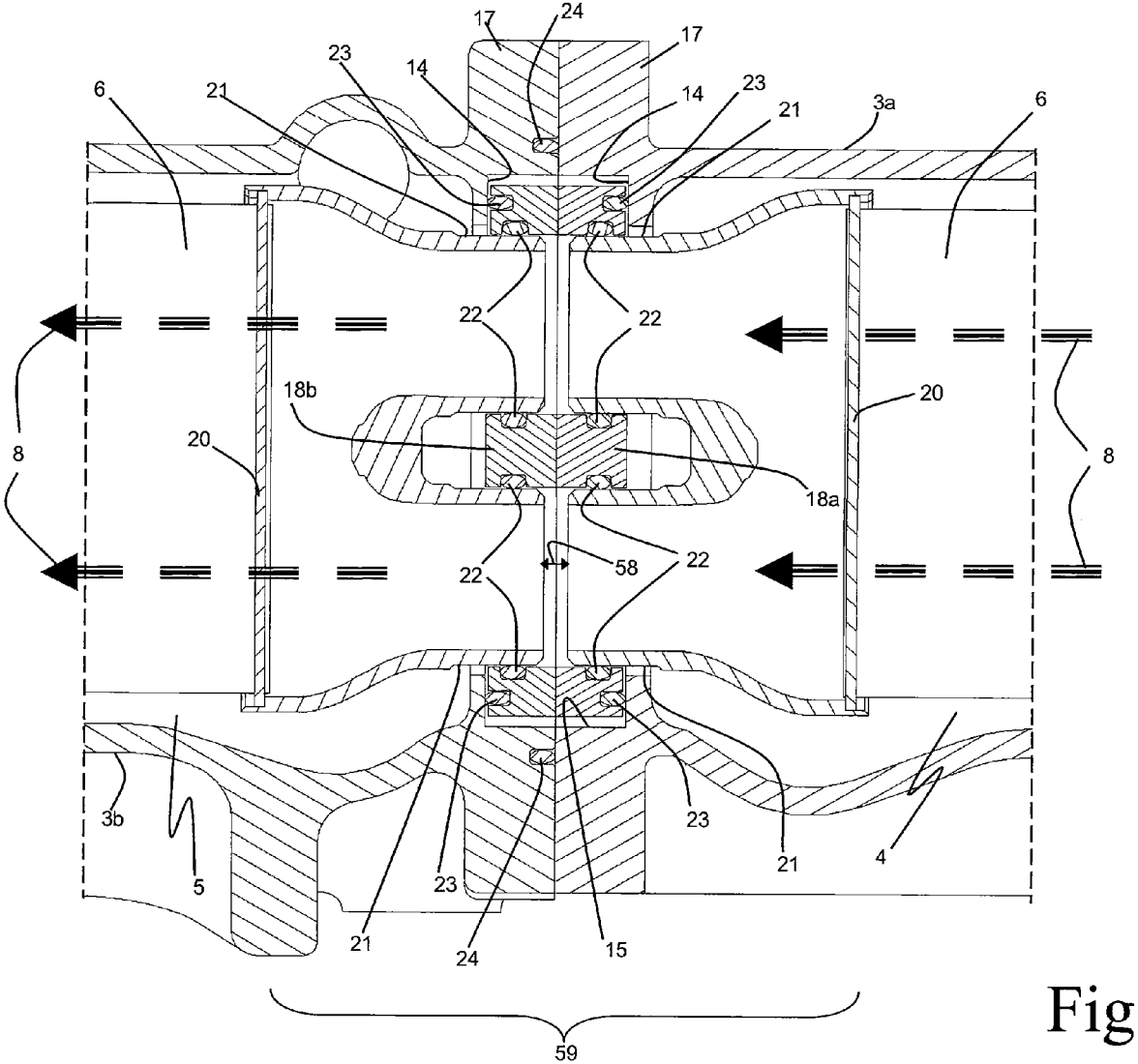
FIG. 8*a* is a sectional detail view of the heat exchanger of FIG. 1, taken along lines VIII-VIII of FIG. 1.

The heat exchange cores 4 and 5 can both be assembled into respective casing sections 3*a*, 3*b* as described above, and the casing sections 3*a* and 3*b* can be joined together at the fastening locations 26 of the casing sections 3*a*, 3*b*. As shown in FIG. 8*a*, assembling of the casing sections 3*a* and 3*b* can mate the end faces 35 (see also, FIG. 5) of the flanges 17 of the casing sections 3*a*, 3*b* against one another. A sealing gasket 24 can also be provided in a groove 27 of at least one of the casing sections 3*a*, 3*b* in order to create a leak-tight seal between the casing sections 3*a*, 3*b*, or can otherwise be retained in place between the casing sections 3*a*, 3*b* for this purpose. Also shown in FIG. 8*a* are additional gaskets 23 located in grooves 30 found in at least one face of the sealing plate 18. Assembly of the casing section 3*a* to the casing section 3*b* can cause the sealing plates 18*a* (assembled to one of the cores 4, 5) and 18*b* (assembled to the other of the cores 4, 5) to contact each other and compress the gaskets 23 against the walls 14 in order to create a leak-tight seal. The fluid-tight seals created by the gaskets 22, 23, and 24, alone or in combination, can prevent fluid communication between fluids traveling along the flow paths 8, 9, and 10, and can similarly prevent leakage of those fluids out of the heat exchanger 1.

Since the location of the cylindrical flow conduits 21 of each of the cores 4, 5 can be allowed to vary relative to the casing section 3*a*, 3*b* into which the core 4, 5 is assembled, the apertures 28 of the sealing plate 18*a* may not be directly aligned with the apertures 28 of the sealing plate 18*b*. However, such non-alignment will not result in the loss of sealing between the fluid streams.

Once the heat exchanger 1 is so assembled, a continuous flow path 8 is defined from the proximal end 11 of the heat exchanger 1 to the distal end 12. The flow path 8 includes a first (upstream) section defined by the tubes 6 of the core 4, extending from the inlet header 7 of the core 4 to the outlet header 20 of the core 4, and further includes a second (downstream) section defined by the tubes 6 of the other core 5, extending from the outlet header 20 of the core 5 to the inlet header 7 of the core 5. A third intermediate section of the heat exchanger 1 is defined by a flow transitioning structure 59 fluidly connecting the upstream and downstream sections just described. The flow transitioning structure 59 extends from the header 20 of the first core 4 to the header 20 of the second core 5.

In some embodiments, the ends of the tubes 6 at both the proximate end 11 and the distal end 12 of the heat exchanger 1 are rigidly attached to the casing 2 by the attachment of the headers 7 to the casing sections 3*a* and 3*b*. In other words, this attachment between the tube ends 6 and headers 7, and the casing 2 is substantially inflexible, and does not permit relative movement between the tube ends 6 and headers 7 and the casing 2. In a similar way, in some embodiments, the flow transitioning structure 59 is rigidly attached (or is relatively inflexible, and does not permit relative movement) at either end to the ends of the tubes 6, by way of the headers 20. In contradistinction, the two ends of the flow transitioning structure 59 are flexibly connected to one another (indirectly through the sealing plates 18*a*, 18*b*) and to the casing 2, and/or are permitted to shift or otherwise move (in at least one direction, and/or at least during thermal expansion of the tubes 6 with respect to the casing 2) based upon the manner in which the flow transitioning structure 59 is assembled. Since the gaskets 22 provide a sliding seal for the cylindrical flow conduits 21 (as is required to enable assembly of the sealing plate 18 over the cylindrical flow conduits 21), and the cylindrical flow conduits 21 of core 4 can be separated from those of core 5 by a gap 58, the tube ends attached to the header 20 of either core are not prevented from displacing some amount in the tube-axial direction, and stresses at the tube-to-header joints by such displacement can be reduced or eliminated.

The flexible joint and/or relative movement enabled by the transitioning structure 59 described above can be especially beneficial in applications where a large thermal expansion differential exists, either between the tubes 6 of core 4 and the tubes 6 of core 5, or between the tubes 6 of either core and the casing 2, or both. Such thermal expansion differences have been known to cause premature failure of heat exchangers by causing high stresses, especially at tube-to-header joints. Consequently, the life of a heat exchanger 1 constructed according to some embodiments of the present invention can be beneficially enhanced.

Figure 8B:
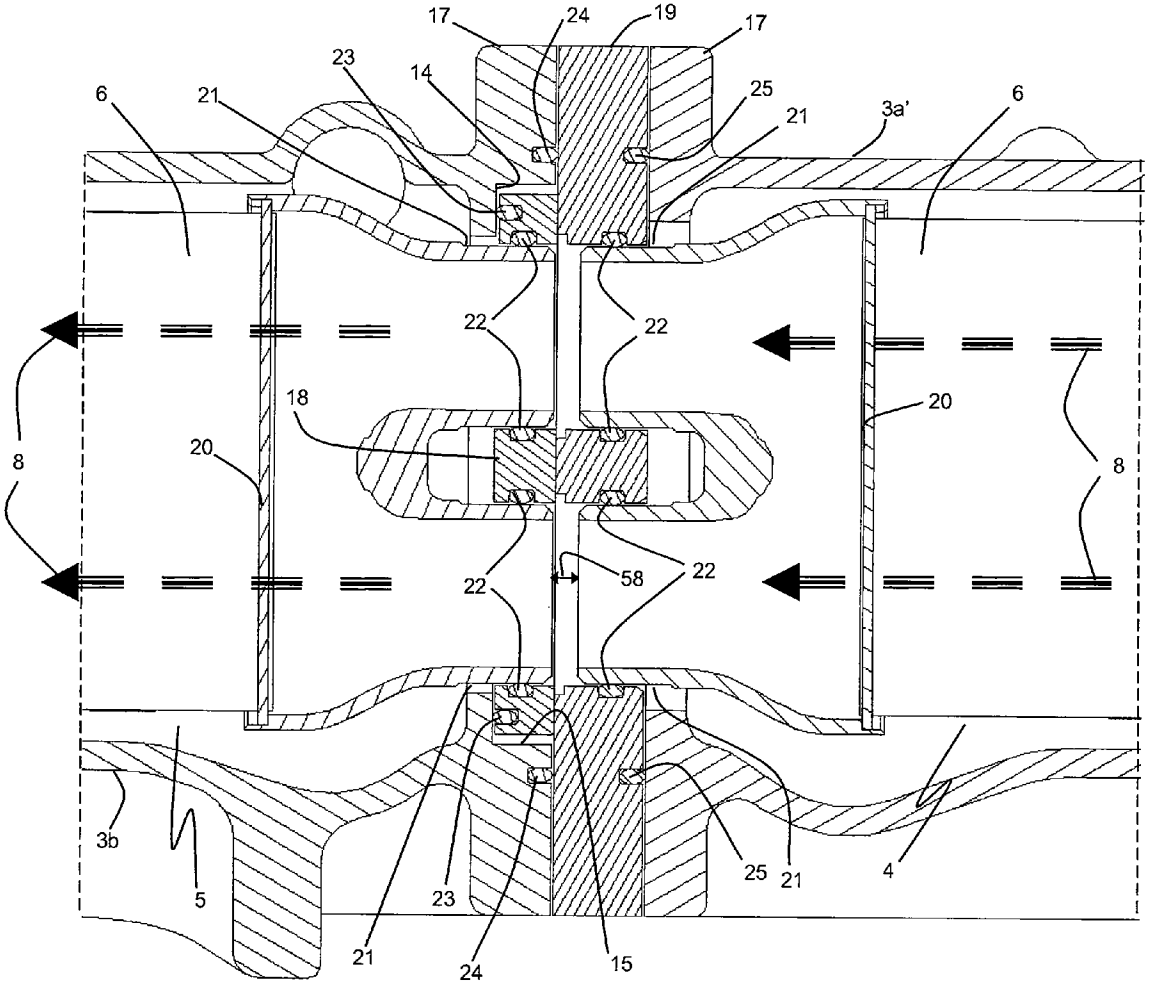
FIG. 8*b* is a sectional detail view of the heat exchanger of FIG. 1 according to an alternative embodiment of the present invention, also taken along lines VIII-VIII of FIG. 1.

Another embodiment of a heat exchanger 1 according to the present invention is illustrated in FIG. 8*b*. In the embodiment of FIG. 8*b*, the pocket 16 (see also, FIG. 5) is found only in one of the casing sections (3*b*). A casing section 3*a*' lacking the pocket 16 has replaced the previous casing section 3*a*. Additionally, the sealing plate 18*a* has been replaced with a larger sealing plate 19, and the gasket 23 found in the previous sealing plate 18*a* has been replaced with a similar gasket 25. In the embodiment of FIG. 8*b*, the sealing plate 19 is included in the joint between the flanges 17 of the casing sections 3*a*' and 3*b*. The seal between fluid flowing along the flow path 8 and fluid flowing along the flow path 10 in this embodiment can be provided solely by the gaskets 22. The new gasket 25 can prevent leakage of fluid flowing along the flow path 10 to the outside of the heat exchanger 1.

Figure 9:
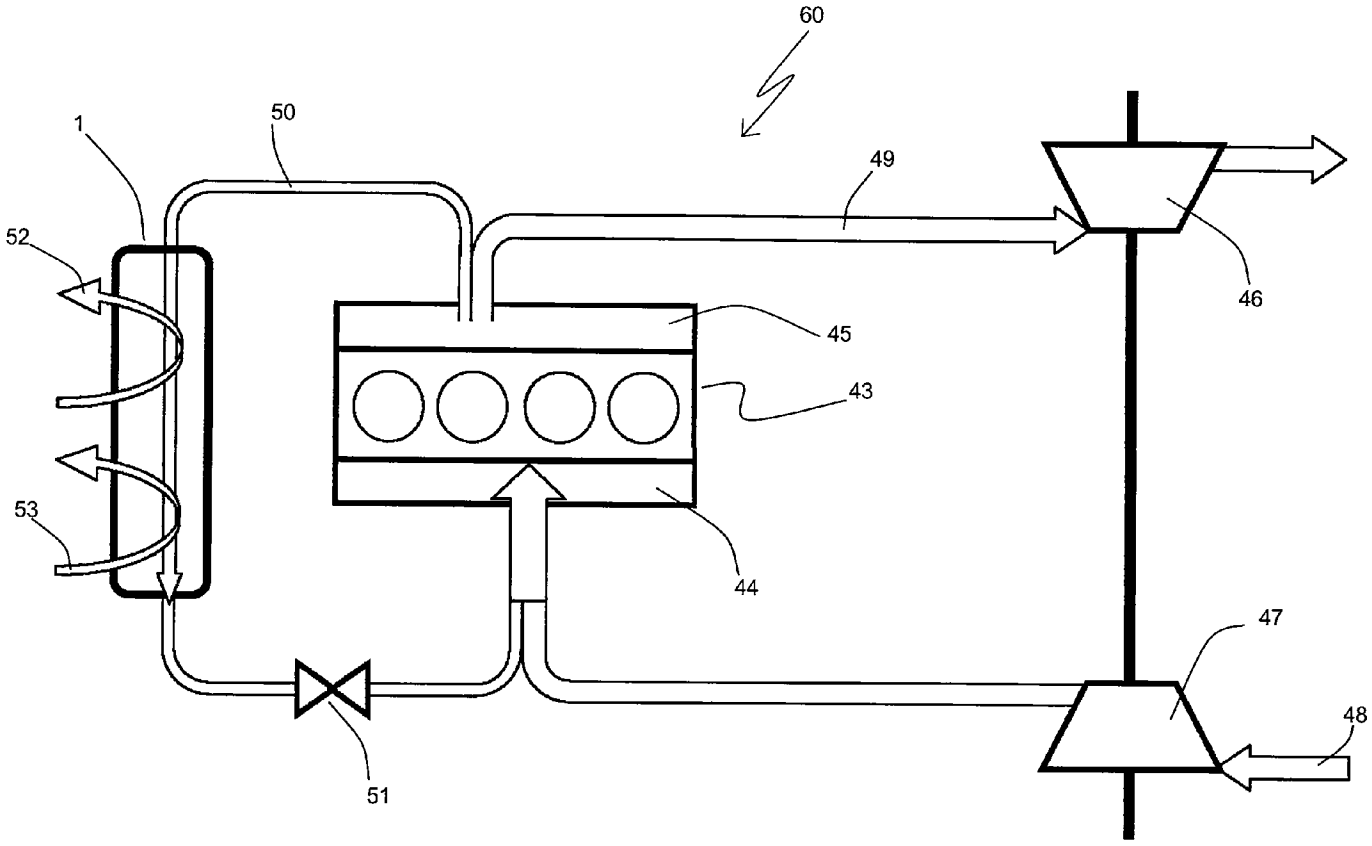
FIG. 9 is a schematic representation of an engine system including a heat exchanger embodying the present invention.

In some embodiments, the heat exchanger 1 can be provided as an EGR cooler for use in an EGR system 60, shown in FIG. 9. The EGR system 60 can include an engine 43 having an intake manifold 44 and an exhaust manifold 45, a compressor 47 coupled to an expander 46, and an EGR valve 51. A portion 49 of the hot, pressurized exhaust flow produced by the engine 43 is directed from the exhaust manifold 45 to the expander 46. The exhaust flow 49 is expanded to a lower pressure in the expander 46, and the energy derived thereby is used to compress a fresh combustion air flow 48 in the compressor 47. The compressed air flow 48 is directed from the compressor 47 to the intake manifold 44.

With continued reference to the embodiment of FIG. 9, another portion 50 of the hot, pressurized exhaust flow produced by the engine 43 is recirculated, by way of the EGR cooler 1 and the EGR valve 51, from the exhaust manifold 45 back to the intake manifold 44, where it is combined with the compressed air flow 48. The recirculated exhaust flow 50 passes through the EGR cooler 1 along the flow path 8 (described above), is cooled by a first coolant flow 52 passing through the heat exchanger 1 along the flow path 10 (described above), and is further cooled by a second coolant flow 53 passing through the heat exchanger 1 along the flow path 9 (also described above).

In some embodiments of the EGR system 60 according to the present invention, the coolant flows 52 and 53 can be recombined at some point in the system. In still other embodiments, the coolant flows 52 and 53 can belong to segregated coolant flow circuits. Also, in some embodiments, the coolant flow 53 enters the EGR cooler 1 at a lower temperature than does the coolant flow 52, or the coolant flow 52 enters the EGR cooler 1 at a lower temperature than does the coolant flow 53.

In some embodiments, the coolant flows 52 and 53 both comprise a conventional engine coolant such as water, ethylene glycol, propylene glycol, other coolant, or any mixture of these coolants. Also, either or both of the coolant flow 52 and 53 can comprise a working fluid for a Rankine cycle waste heat recovery system.

Various alternatives to the features and elements of the present invention are described with reference to specific embodiments of the present invention. With the exception of features, elements, and manners of operation that are mutually exclusive of or are inconsistent with each embodiment described above, it should be noted that the alternative features, elements, and manners of operation described with reference to one particular embodiment are applicable to the other embodiments.

The embodiments described above and illustrated in the figures are presented by way of example only and are not intended as a limitation upon the concepts and principles of the present invention. As such, it will be appreciated by one having ordinary skill in the art that various changes in the elements and their configuration and arrangement are possible without departing from the spirit and scope of the present invention.

What is claimed is:

1. A heat exchanger comprising:

a casing having a first end and a second end;

a fluid flow path extending between the first end and the second end;

a first plurality of heat exchange tubes defining a first section of the fluid flow path, the first plurality of heat exchange tubes having a first end and a second end;

a first header plate rigidly attaching the first end of the first plurality of heat exchange tubes to the first end of the casing;

a second plurality of heat exchange tubes defining a second section of the fluid flow path, the second plurality of heat exchange tubes having a first end and a second end;

a second header plate rigidly attaching the second end of the second plurality of heat exchange tubes to the second end of the casing; and a third section of the fluid flow path fluidly connecting the first and second sections of the fluid flow path, the third section including a sealing plate, a first end, and a second end;

the sealing plate of the third section having one or more apertures for the fluid flow path to pass therethrough;

the first end of the third section attached to the second end of the first plurality of heat exchange tubes and movable in at least one direction with respect to the casing and the second plurality of heat exchange tubes while maintaining the fluid flow path; and the second end of the third section attached to the first end of the second plurality of heat exchange tubes and movable in at least one direction with respect to the casing and the first plurality of heat exchange tubes while maintaining the fluid flow path.

2. The heat exchanger of claim 1, wherein the casing comprises a first casing section comprising the first end of the casing and a second casing section comprising the second end of the casing, wherein the first casing section and the second casing section are sealingly joined at a location between the second end of the first plurality of heat exchange tubes and the first end of the second plurality of heat exchange tubes.

3. The heat exchanger of claim 1, wherein the casing includes a pocket containing at least a portion of the sealing plate, the pocket being defined at least in part by a wall of the casing providing a sealing surface for a fluid-tight seal between the casing and the sealing plate.

4. The heat exchanger of claim 3, wherein the wall is a first wall, the sealing plate is a first sealing plate, and the sealing surface is a first sealing surface, the pocket being further defined by a second wall spaced apart from the first wall and providing a second sealing surface for a fluid-tight seal between the casing and a second sealing plate having at least one aperture for the fluid flow path to pass therethrough.

5. The heat exchanger of claim 3, wherein the pocket provides a clearance gap between the wall of the casing and an adjacent periphery of the sealing plate located within the pocket.

6. The heat exchanger of claim 3, wherein the third section of the fluid flow path includes a first cylindrical flow conduit attached to the second end of the first plurality of heat exchange tubes, and a second cylindrical flow conduit attached to the first end of the second plurality of heat exchange tubes, wherein at least one of the first and second cylindrical flow conduits extends at least partially into the pocket.

7. The heat exchanger of claim 6, wherein the one or more apertures of the sealing plate contains one or more fluid-tight seals extending around one or more of the first and second cylindrical flow conduits, and wherein the one or more apertures allow the one or more of the first and second cylindrical flow conduits to move relative to the casing in an axial direction.

8. The heat exchanger of claim 7, wherein at least one of the first and second cylindrical flow conduits is separated from another of the first and second cylindrical flow conduits in the axial direction to accommodate thermal expansion differences between the casing and the first and second plurality of heat exchange tubes.

9. The heat exchanger of claim 7, wherein the fluid flow path is a first fluid flow path, the heat exchanger further comprising:

a second fluid flow path extending through at least a portion of the casing and passing over the first plurality of heat exchange tubes; and a third fluid flow path extending through at least a portion of the casing and passing over the second plurality of heat exchange tubes;

wherein the first fluid flow path is fluidly sealed from the second and the third fluid flow paths by at least one of the fluid-tight seals.

10. The heat exchanger of claim 9, wherein the second and third fluid flow paths are separated from fluid communication with one another within the heat exchanger.

11. A heat exchanger comprising:

a casing having a first end and a second end;

a fluid flow path extending between the first end and the second end;

a first plurality of heat exchange tubes defining a portion of the fluid flow path, the first plurality of heat exchange tubes having a first end and a second end;

a first header plate rigidly attaching the first end of the first plurality of heat exchange tubes to the first end of the casing;

a second plurality of heat exchange tubes defining a portion of the fluid flow path, the second plurality of heat exchange tubes having a first end and a second end;

a second header plate rigidly attaching the second end of the second plurality of heat exchange tubes to the second end of the casing; and a flow transitioning structure defining a portion of the fluid flow path between the second end of the first plurality of heat exchange tubes and the first end of the second plurality of heat exchange tubes, the flow transitioning structure permitting movement of the second end of the first plurality of heat exchange tubes with respect to the first end of the second plurality of heat exchange tubes in at least one direction while maintaining the fluid flow path.

12. The heat exchanger of claim 11, wherein the casing includes a pocket containing at least a portion of the flow transitioning structure, the pocket being at least partially defined by a wall providing a sealing surface for a fluid-tight seal between the casing and the flow transitioning structure.

13. The heat exchanger of claim 12, wherein the wall is a first wall, and the sealing surface is a first sealing surface, the pocket being at least partially defined by a second wall spaced apart from the first wall and providing a second sealing surface for a fluid-tight seal between the casing and the flow transitioning structure.

14. The heat exchanger of claim 12 wherein the fluid flow path is a first fluid flow path, the heat exchanger further comprising:

a second fluid flow path extending through at least a portion of the casing and passing over the first plurality of heat exchange tubes; and a third fluid flow path extending through at least a portion of the casing and passing over the second plurality of heat exchange tubes;

wherein the flow transitioning structure seals the first fluid flow path from the second and third fluid flow paths.

* * * * *